US012669075B2

(12) United States Patent
Hemmann et al.

(10) Patent No.: US 12,669,075 B2
(45) Date of Patent: Jun. 30, 2026

(54) CONDITION BASED OIL MANAGEMENT

(71) Applicant: INNIO Jenbacher GmbH & Co OG, Jenbach (AT)

(72) Inventors: Moritz Hemmann, Innsbruck (AT); Günther Wall, Bad Häring (AT)

(73) Assignee: Innio Jenbacher GmbH & Co OG, Jenbach (AT)

( * ) Notice: Subject to any disclaimer, the term of this patent is extended or adjusted under 35 U.S.C. 154(b) by 0 days.

(21) Appl. No.: 18/604,419

(22) Filed: Mar. 13, 2024

(65) Prior Publication Data

US 2024/0309783 A1 Sep. 19, 2024

(30) Foreign Application Priority Data

Mar. 14, 2023 (DE) ..... 102023106324.3

(51) Int. Cl.
*F01M 11/10* (2006.01)
*F01M 5/00* (2006.01)
*F01M 11/02* (2006.01)

(52) U.S. Cl.
CPC ..... *F01M 11/10* (2013.01); *F01M 5/002* (2013.01); *F01M 11/02* (2013.01)

(58) Field of Classification Search
CPC ..... F01M 11/10; F01M 5/002; F01M 11/02
See application file for complete search history.

(56) References Cited

U.S. PATENT DOCUMENTS 11,175,274 B2 11/2021 Zhang et al.
2002/0178780 A1 12/2002 Van Mullekom et al.
2004/0168959 A1* 9/2004 Cousineau ..... F01M 11/03 210/243
2007/0074562 A1 4/2007 Liu et al.
2009/0315574 A1* 12/2009 Akiyama ..... G01N 33/2888 324/698
2014/0019068 A1* 1/2014 Schneider ..... G01N 33/2888 702/30
2016/0003794 A1 1/2016 Basu et al.
2017/0010624 A1* 1/2017 Carpenter ..... B64U 70/93
2017/0102308 A1 4/2017 Gillette, II et al.
2018/0087414 A1* 3/2018 Baxter ..... F01M 5/002
2020/0378283 A1 12/2020 Zhang et al.
(Continued)

FOREIGN PATENT DOCUMENTS

DE 102004032344 A1 1/2006
DE 102005039480 A1 3/2007
(Continued)

OTHER PUBLICATIONS

German Office Action of DE Application No. 102023106324.3, dated Dec. 15, 2023; 9 pages.
(Continued)

*Primary Examiner* — Syed O Hasan
(74) *Attorney, Agent, or Firm* — Fletcher Yoder, P.C.

(57) ABSTRACT

Method for monitoring a lubricant of a combustion engine, wherein measured numerical values are acquired with at least one sensor over a running time of a combustion engine, wherein the measured numerical values are representative of an oil quality of an engine oil of the combustion engine, wherein an oil sampling interval is adapted depending on at least one measured numerical value and/or a variable derived therefrom.

23 Claims, 3 Drawing Sheets

(56) References Cited

U.S. PATENT DOCUMENTS

| | | | | |
|---|---|---|---|---|
| 2021/0231634 | A1 | 7/2021 | Gillette et al. | |
| 2022/0163505 | A1 * | 5/2022 | Pjetri | G01N 27/226 |

FOREIGN PATENT DOCUMENTS

| | | | | |
|---|---|---|---|---|
| DE | 102006059071 | A1 | 6/2008 | |
| DE | 102020004529 | A1 | 1/2022 | |
| EP | 4431707 | A2 * | 9/2024 | F01M 11/02 |

OTHER PUBLICATIONS

Canadian Office Action of CA Application No. 3,231,877 dated Jul. 15, 2025; 4 pages.

European Extended Search Report of EP Application No. 24161467.6 / 4431707 dated Sep. 2, 2024, 6 pages.

* cited by examiner

CONDITION BASED OIL MANAGEMENT

CROSS-REFERENCE TO RELATED APPLICATION

This application claims priority to and benefit of German Application No. DE102023106324.3, filed on Mar. 14, 2023, entitled "CONDITION BASED OIL MANAGEMENT", which is herein incorporated by reference in its entirety.

BACKGROUND

The present invention relates to a method for monitoring a lubricant of a combustion engine with the features of the claims, a combustion engine with the features of the claims, as well as a computer program product and a data carrier signal.

In order to be able to implement a reliable operation and a long lifespan of a combustion engine, a prerequisite is to ensure a certain lubricant quality in order to be able to guarantee a lubrication of the moving parts of a combustion engine.

In general, an engine oil of the combustion engine serving as lubricant is exposed to various stresses during ongoing operation, as a result of which the oil quality decreases.

Such a reduction in oil quality occurs due to a depletion of the lubricant additives, which fulfill specific functions such as viscosity control, wear, ageing, increasing the lubricity, minimizing deposits, preventing oxidation, and other desired properties.

A reduction in quality of the engine oil can also occur through the absorption of foreign material into the engine oil, such as dirt from the environment, and wearing materials from the combustion engine, which occur as part of the natural operating procedure, and combustion residues from the combustion process.

Factors which influence the oil quality are intensive and/or long contact with combustion gases, intensive and/or long contact with hot and/or large surfaces, high temperatures or contact with catalytically active substances (such as, for example, metals such as copper or iron) in the combustion engine.

When a particular lower quality limit value is reached, the engine oil must be changed.

A time for an engine oil change can be prespecified at particular intervals (for example by operating hours or after reaching a period of time, such as for example 5 years) or by checking the quality of the engine oil continuously, wherein the engine oil change is to be carried out when particular quality limit values are reached.

Significant parameters for the oil quality are, among other things, the iron content, the oxidation rate, or also the i-pH value.

Substantial effort and costs are moreover associated with disposing of the considerable quantity of engine oil and refilling again (wherein, in the case of stationary internal combustion engines, engine oil quantities of up to several thousand litres are to be expected).

It is therefore necessary to find a way to determine the oil quality in as current a manner as possible and sufficiently accurately in order to be able to use the engine oil for as long as possible with a low risk, before an oil change (and the service work associated therewith) falls due.

It is therefore known from the state of the art to take oil samples, after prespecified numbers of operating hours of the combustion engine (thus at a prespecified oil sampling interval), which are then analyzed in a complex manner with respect to their individual ingredients in a laboratory, and based on the analysis information can be given about how far advanced an ageing of the engine oil already is, whereby it can be deduced whether the engine oil can continue to be used or should be changed. Such an analysis follows, for example, from US 2016/0003794 A1.

However, a disadvantage of this is that—in order to be able to guarantee a sufficient operating safety—samples of the lubricant have to be taken from the combustion engine relatively frequently and have to be analyzed using a large amount of effort and complex analysis methods.

Further disadvantages are the discontinuous monitoring of the oil quality and the time delay between the oil sampling and the availability of the analysis results that is a consequence of the analysis method.

A further possibility for monitoring a lubricant and drawing conclusions with respect to an oil quality follows from the use of special sensors (such as, for example, disclosed by US 2009/0315574 A1), which can be placed directly on the combustion engine. These sensors are used to directly infer an oil quality via a determined electrochemical state variable (for example, the electrical conductivity) of the engine oil. Such a use is shown for example by US 2020/0378283 A1.

However, a disadvantage of the use of corresponding sensors is that the oil quality determination takes place in a very inaccurate manner as the measured values of the sensor are heavily dependent on operating parameters of the combustion engine, such as for example the oil temperature or the foreign particle content of the oil.

Thus, during the measurement using corresponding sensors, deviations from the actual oil quality that are too great result when deposits form in the area of the sensor or corresponding particles carried in the engine oil flow through the measurement area of the sensor during the measurement.

Consequently, there is a desire arising from the state of the art for a possibility by means of which a less complex and nevertheless as reliable as possible a monitoring of the condition of a lubricant of a combustion engine can be performed.

BRIEF DESCRIPTION

The desire of embodiments of the present invention is therefore to improve the previously described disadvantages of the state of the art at least in part and/or to provide a method and a combustion engine with the aid of which a monitoring of a lubricant of the combustion engine can be carried out more easily and/or more cost-effectively and/or using less effort.

This desire is achieved by a method for monitoring a lubricant of a combustion engine with the features of the claims, a combustion engine with at least one oil circuit with the features of the claims, a computer program product (e.g., computer instructions or commands stored on a tangible, computer-readable medium such as memory, and executable by a processor) with the features of the claims, and a data carrier signal with the features of the claims.

According to embodiments of the invention, a method for monitoring a lubricant of a combustion engine provided, wherein measured numerical values are acquired with at least one sensor over a running time of a combustion engine, wherein the measured numerical values are representative of an oil quality of an engine oil of the combustion engine, wherein an oil sampling interval is adapted depending on at least one measured numerical value and/or a variable derived therefrom.

Through the method according to embodiments of the invention, a complex and extensive analysis in the laboratory, which provides accurate information on an oil quality, can thus be better planned, because measured numerical values characteristic of the oil quality of the engine oil are taken via at least one sensor in ongoing operation of the combustion engine, which although this represents an incomplete form of the oil quality measurement compared with one in a specialized laboratory, it is sufficient to be used to carry out the complex and more informative analysis in the laboratory corresponding/optimized to the operating state because the detailed analysis in the laboratory by taking oil samples of engine oil of the combustion engine is only performed when it is actually necessary or advisable.

Consequently, according to embodiments of the invention and the targeted monitoring of the condition of the lubricant according to embodiments of the invention, the lubricant of the combustion engine can be utilized in a more resource-saving and efficient manner.

Combustion engines can include thermal working machines in which energy released as heat by combustion is converted into mechanical work, such as, for example, in Otto engines, in particular gas engines, diesel engines, gas turbines, boilers or the like.

Combustion engines, in particular stationary combustion engines, can be used to drive generators for power generation. Such designs are often also called gensets.

It can also be provided that embodiments of the invention are used in already existing systems of the state of the art and corresponding combustion engines (such as, for example, described in the introduction to the description) and are preferably installed subsequently.

Oils, and engine oils, may include in the present document lubricants for use in combustion engines, which are utilized to lubricate and/or cool the combustion engine and individual components thereof. Engine oils and oils are thus not to be interpreted as fuels of the combustion engine, which are used in the course of the combustion process of the combustion engine.

A quality of the lubricant, oil or engine oil may include in the present document the actual quality and not information regarding an amount, a volume or another quantity.

Advantageous embodiments of the invention are defined in the dependent claims.

It can be provided that the oil sampling interval defines the point in time for taking an oil sample from the combustion engine at which an oil sample is to be taken from the combustion engine for investigation in a laboratory. Thus, for example, the recommendation can signal that an oil sample is to be taken immediately or also when a particular number of operating hours of the combustion engine is reached.

It can preferably be provided that a defined oil sampling interval (for example, every 500 operating hours) is adapted by the adaptation, wherein, for example, the time interval is shortened and/or lengthened when the measured values change. It can be provided that an item of information about oil sampling interval is output continuously or on request.

It can be provided that, if no adaptation of the oil sampling interval is necessary due to the measured values, a notification is output according to a prespecifiable defined oil sampling interval (for example, every 500 operating hours).

The oil sampling interval defines a recommendation for taking an oil sample from the combustion engine for investigation in a laboratory, wherein of course a recommendation is only output for a user or operator of the combustion engine. This recommendation is to be implemented by the user or operator of the combustion engine if they desire a trouble-free operation of the combustion engine (manufacturer's guarantee or warranty terms can optionally be linked to the implementation of this recommendation). However, ultimately the implementation of the recommendation for taking an oil sample from the combustion engine according to the oil sampling interval for investigation in a laboratory may still be at the user's or operator's discretion.

It can preferably be provided that an absolute value of the oil quality is derived from at least one measured numerical value, which absolute value is used for adapting the oil sampling interval.

It can be provided that a plurality of measured numerical values determined at time intervals and/or variables derived therefrom are used for adapting the oil sampling interval.

It can preferably be provided that a rate of change of at least two, preferably successive, measured values at a time interval and/or variables derived therefrom is determined.

The rate of change can, for example, relate to an increase in an imaginary, linear connection between two measured values, plotted on a graph of the oil quality over the number of operating hours, which is determined on the basis of tests and experiments. This rate of change (increase) can then be compared with a determined rate of change (increase) of the measured values currently being measured by the at least one sensor.

It can, for example, be provided that a plurality of measured numerical values is ascertained during time intervals, wherein the plurality of measured numerical values ascertained during a time interval is evened out (for example, by determining an average value or a median) and is thus converted, for example, into a variable derived from the numerical variables.

This variable derived from measured numerical values ascertained during one time interval can be used, with a further derived variable (for example, determined in the same way) which was preferably determined during a second time interval, in particular starting directly, to determine the rate of change.

It can be provided that the oil sampling interval is adapted depending on the rate of change.

It can preferably be provided that at least two measured numerical values measured at a particular time interval and/or variables derived therefrom are evened out, preferably by generating an average value and/or median of the measured values, for adapting the oil sampling interval.

It can be provided that at least two measured numerical values and/or variables derived therefrom are determined, preferably continuously, by the at least one sensor at prespecified points in time, at time intervals prespecified relative to each other and/or in defined operating conditions of the combustion engine.

These prespecified points in time and/or time intervals can vary in the course of operation and need not necessarily be constant.

It can also be provided that the at least one sensor carries out a measurement continuously, wherein individual measured values of the continuous measurement are used or taken.

It can preferably be provided that the measured numerical values and/or variables derived therefrom are acquired with a measurement frequency in a range between 0.5 Hz and 3 Hz.

It can be provided that an electrochemical state variable, preferably an electrical conductivity and/or permittivity and/or electrical capacitance, of the engine oil is measured by the at least one sensor, which electrochemical state variable represents the measured numerical value characteristic of the oil quality of the engine oil. Such a sensor can be formed, for example, as explained by US 2009/0315574 A1.

Examples of measured variables of the at least one sensor are, for example, the iron content, the oxidation rate, the water content or also the i-pH value of the lubricant or engine oil.

The measurement of the at least one sensor can, for example, be effected via an electrical conductivity and/or permittivity and/or an electrical capacitance of the lubricant and/or engine oil, and also as an optical measurement.

It can preferably be provided that the measured numerical values and/or the variables derived therefrom are compared with a defined condition, wherein—if the measured values do not correspond to the condition—the oil sampling interval is adapted.

The condition can thus correspond, for example, to a calculated, computed or also estimated reduction in quality of the engine oil during the ongoing operation of the combustion engine, wherein this condition is checked via the at least one sensor and an adaptation of the oil sampling interval is only recommended when the oil quality measured via the at least one sensor does not correspond to the computed, predicted or estimated reduction in the oil quality.

It can be provided that, through the condition, an ageing rate for engine oils determined under normal conditions and/or in tests is returned in dependence on operating hours of the combustion engine.

A normal condition of a combustion engine can, for example, relate to an operation of the combustion engine under optimum operational conditions, which is present without technical defects—preferably under test conditions.

The dependence on the operating hours of the combustion engine can relate to the operating hours performed by the combustion engine since the last engine oil change (thus, a number of operating hours of the combustion engine, during which the same engine oil is already in use).

It can preferably be provided that, through the condition, a range is returned, which range preferably takes an acceptable variation in the oil quality and/or a measuring inaccuracy of the at least one sensor into account.

Thus, for example, it can be provided that for one thing, through the condition formed as a range, a range is returned in which the measured oil quality of the engine oil which is acceptable with respect to, for example, a number of operating hours can be found (and in which range a further smooth operation of the combustion engine can be guaranteed).

Furthermore, the condition formed as a range can take measuring inaccuracies of the at least one sensor into account (for example+/−5%), with the result that variations in the measured values, which are entirely acceptable, do not directly lead to a "false alarm".

It can preferably be provided that a period between the determination of two successive measured values by the at least one sensor is shortened or lengthened if the measured values and/or a variable derived therefrom are approaching a limit of the condition.

Thus, for example, it can be provided that—if the measured numerical values of the at least one sensor or a variable derived therefrom are approaching a threshold of the condition—the interval between the measurements is shortened, in order to be able to ascertain as early as possible an exceeding of the measured values outside the condition and to be able to respond accordingly in good time by adapting the oil sampling interval.

For another thing, it can also be provided that—if the measured numerical values of the at least one sensor or a variable derived therefrom are moving away from a threshold of the condition—the interval between the measurements is lengthened, in order to be able to use the sensor and involved components in a more resource-saving manner (for example, to increase their service life through reduced use).

It can be provided that the oil sampling interval is output in the form of a notification and preferably a change in the oil sampling interval is output in the form of a warning.

It can be provided that the notification and/or the warning is provided to a user of the combustion engine acoustically and/or visually.

It can also be provided, for example, that the notification is effected in the form of an automated taking of an oil sample from the combustion engine taking the adapted oil sampling interval into account.

It can preferably be provided that the measured numerical values of the at least one sensor and/or the variables derived therefrom are subjected to a plausibility check before the adaptation of the oil sampling interval, preferably wherein the measured numerical values and/or the variables derived therefrom are used for the adaptation of the oil sampling interval only if the measured numerical values and/or the variables derived therefrom lie within prespecified plausibility limits.

Thus, for example, measurement errors or sensor errors can be ruled out, because they are detected. The plausibility limits can for example be adapted in a variable manner in ongoing operation, with the result that they are preferably adapted in dependence on the number of operating hours, in order to rule out measurement errors and/or sensor errors.

If the measured numerical values of the at least one sensor and/or the variables derived therefrom do not lie within prespecified plausibility limits, the method can for example be terminated or carried out afresh. A repetition of the measurement by the at least one sensor is also entirely conceivable.

If the measurement is repeated by the at least one sensor and the measured numerical values of the at least one sensor and/or the variables derived therefrom continue not to lie within the plausibility limit, a notification can, for example, be output which questions the functioning of the sensor or the measuring system and preferably asks a user to check these components.

Such deviations, wherein the measured numerical values of the at least one sensor and/or the variables derived therefrom lie outside plausibility limits, can for example be caused by the contamination of the at least one sensor, the malfunctioning of the at least one sensor and/or the malfunctioning of a measuring system including the at least one sensor.

It can be provided that the measured numerical values of the at least one sensor and/or the variables derived therefrom are provided by the at least one sensor during defined operating conditions of the combustion engine.

Corresponding defined operating conditions of the combustion engine can, for example, be the ongoing operation of the combustion engine (and thus not the idle state) or also relate to a certain operating temperature of the engine oil (for example, above 65° C.), as well as a certain load requirement, rotational speed or ambient temperature of the combustion engine.

This definition of the operating condition of the combustion engine, during which the measured numerical values are acquired by the at least one sensor, means that with a changing operating condition (such as, for example, the temperature of the engine oil) strong influences on the physical properties (such as, for example, the conductivity, the viscosity or the like) of the engine oil also become apparent. Thus, for example, the measured numerical values of the at least one sensor vary greatly at different temperatures as well as flow velocities and flow rates of the engine oil at the at least one sensor.

It can be provided that the measured numerical values are ascertained by the at least one sensor outside the defined operating conditions, but these are not used for monitoring the condition of a lubricant of a combustion engine.

It can preferably be provided that—if a deviation of the measured values and/or the variables derived therefrom exceeds a prespecifiable tolerance range—a critical notification is output, which critical notification preferably interrupts and/or limits the operation of the combustion engine (for example, a power of the combustion engine is reduced).

It can thus be provided that—if the measured numerical values and/or variables derived therefrom rapidly change for the worse—a further threshold value can be exceeded, which is formed by the tolerance range, and a critical notification is output, which immediately stops the operation of the combustion engine or restricts the operation of the combustion engine (for example, by reducing a power of the combustion engine), as a safe, further operation of the combustion engine cannot be guaranteed.

Such a rapid deterioration of the engine oil can, for example, occur if damage arises in the combustion engine and for example particles, chippings or elements otherwise removed load the engine oil to an increased extent and/or particles from the combustion get into the engine oil to an increased extent.

It can be provided that a method for monitoring a lubricant condition of a combustion engine comprises the following steps:

acquiring measured values with the at least one sensor over a running time of a combustion engine, wherein the measured values are representative of the oil quality of the combustion engine;

determining an absolute value of the oil quality at time intervals $\Delta tn$ (n=1, 2, 3, . . . ) via the measured values determined at the same time interval $\Delta tn$, adapting the oil sampling interval depending on the determined absolute value of the oil quality.

It can be provided that a rate of change of the absolute value of the oil quality between at least two time intervals $\Delta tn$ and $\Delta tn+1$ is determined.

It can preferably be provided that the oil sampling interval is in addition adapted depending on the rate of change of the absolute value.

It can be provided that at least two measured values measured over a particular time interval $\Delta tn$ (n=1, 2, 3, . . . ) are evened out for all time intervals $\Delta tn$, preferably by generating an average value of the measured values.

It can preferably be provided that the measured values are acquired substantially continuously.

It can be provided that—if either the absolute value of the oil quality and/or the rate of change of the oil quality reaches a predefined limit value—the oil sampling interval is adapted.

It can preferably be provided that the oil sampling interval is displayed via a display device and, in the event of a change in the oil sampling interval, a corresponding warning is also output.

Protection is furthermore sought for a combustion engine with at least one oil circuit, comprising an engine oil transported in the oil circuit for lubricating and/or cooling the combustion engine, wherein the combustion engine furthermore comprises at least one sensor for acquiring measured numerical values characteristic of an oil quality of the engine oil and a control or regulating device to which the characteristic measured numerical values of the at least one sensor can be provided, characterized in that the control or regulating device is formed, for monitoring the condition of a lubricant of the combustion engine, to adapt an oil sampling interval depending on at least one measured numerical value and/or a variable derived therefrom.

It can be provided that the oil circuit of the combustion engine has at least one oil cooler and at least one oil filter connected downstream in the flow direction of the engine oil, wherein the at least one sensor is arranged in the oil circuit between the at least one oil cooler and the at least one oil filter.

Through the arrangement of the at least one sensor following the oil cooler in the flow direction of the engine oil through the oil circuit, it is ensured that the engine oil has as constant as possible a temperature at the at least one sensor during the operation of the combustion engine, with the result that, with regard to the temperature of the engine oil, optimum conditions for comparable characteristic measured numerical values arise at the at least one sensor.

The measurement of the at least one sensor is not influenced by the oil filter due to the at least one sensor being arranged before the at least one oil filter in the flow direction of the engine oil, wherein, after the filtration through the oil filter, purified conditions and measured numerical values characteristic of the oil quality that are not significant can be acquired.

Protection is furthermore sought for a computer program product, comprising commands which, when the program is executed by a control or regulating device of a combustion engine, prompt it to carry out a method according to embodiments of the invention.

Protection is likewise sought for a data carrier signal which carries the computer program product according to embodiments of the invention.

It can be provided that the control or regulating device has a display device or is connected to one in a signal-carrying manner, wherein the oil sampling interval, the at least one measured numerical value and/or the variable derived therefrom can be output clearly for a user by the control or regulating device via the display device.

It can also be provided that a change in the oil sampling interval can be output via the display device. Thus, for example, it can be provided that a time for the next taking of an oil sample from the combustion engine according to the oil sampling interval for investigation in the laboratory is displayed continuously via the display device. When the oil sampling interval is adapted depending on the at least one measured numerical value and/or the variable derived therefrom, the change is output.

The oil sampling interval can, for example, be provided in a wide variety of forms for a user, an operator or a co-operating control or regulating device, such as for example by a visual signal, a control signal, digital signals, signals stored in a cloud or the like.

It can be provided that a central control or regulating device of the combustion engine undertakes the function of the control or regulating device.

However, it is also possible for the control or regulating device to be connected or connectable to the combustion engine via a LAN, WLAN and/or a remote data transmission connection (e.g., internet). Mixed forms are also conceivable, wherein certain functions of the control or regulating unit are realized in the combustion engine and certain other functions are realized remote from the combustion engine.

An embodiment in which the control or regulating unit is formed by structurally separate computing units, which computing units are connected to each other in a signal-carrying manner, is also entirely conceivable. An embodiment in which resources of the control or regulating device are shared is also conceivable.

For example, it could also be provided that the measured value generated by the at least one sensor in the combustion engine is processed in a central control or regulating device, wherein a display of an optionally output notification is provided in a portal accessible from anywhere. Of course, conversely there is also once again the possibility of sending a signal from a portal accessible anywhere to the central control or regulating device of the combustion engine.

It can furthermore be provided that, in the context of evaluation, data are calculated for a visualization—i.e., a screen display or the like—for users.

It can, for example, be provided that, during the analysis by the control or regulating device, data are calculated for the visualization, which can then be passed on in the form of a notification via a data transmission connection to the combustion engine and therein can be displayed clearly for the user on a screen.

BRIEF DESCRIPTION OF THE DRAWINGS

Further advantages and details of the invention are revealed by the figures and the associated description of the figures. There are shown in.

DETAILED DESCRIPTION

Figure 1:
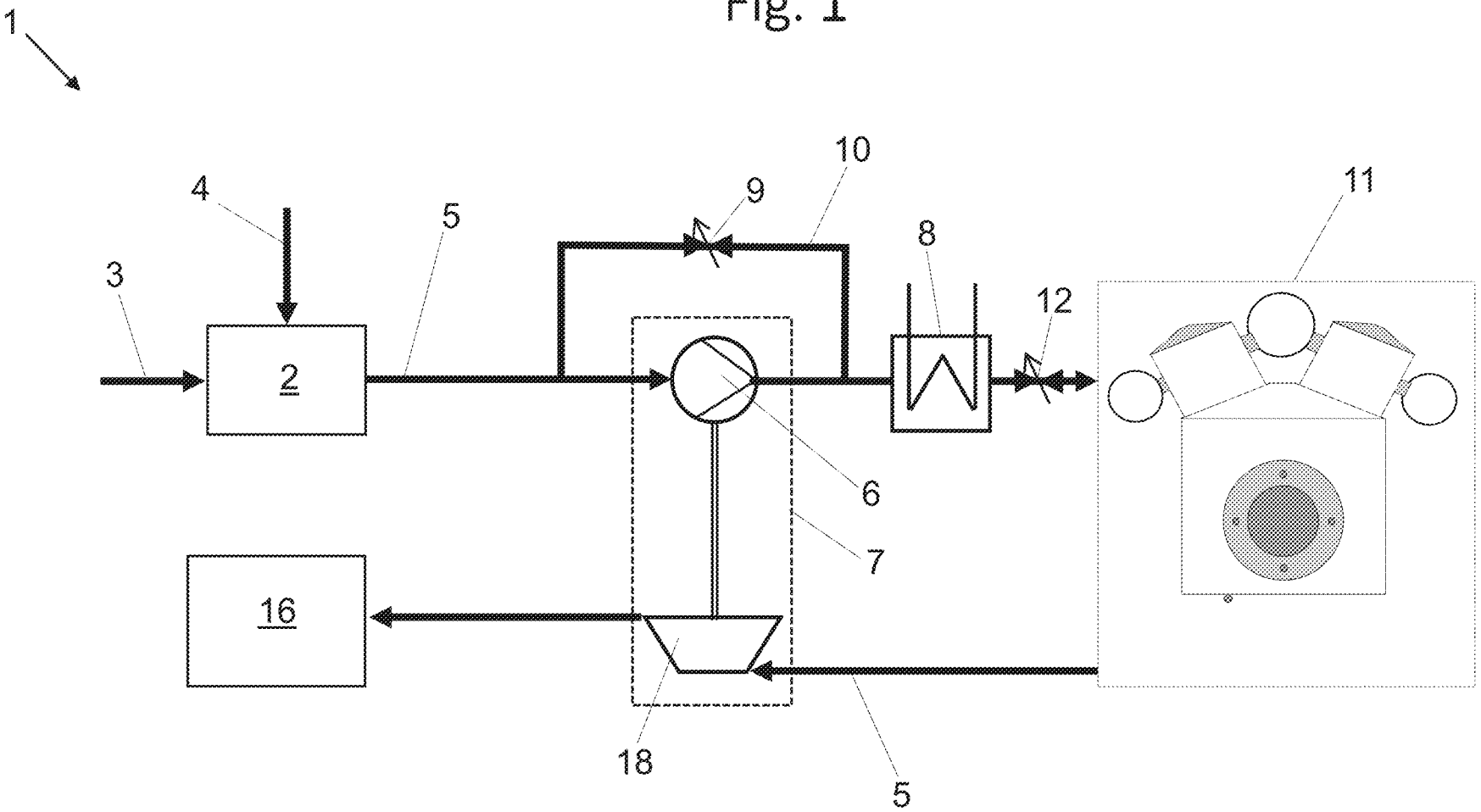
FIG. 1 illustrates an embodiment example of a combustion engine.

FIG. 1 shows a schematic representation of a first embodiment example of a combustion engine 1, wherein the material flows of the combustion engine 1 are illustrated.

This embodiment variant is a stationary, gas-operated combustion engine 1.

Thus, first of all, air 3 and a fuel 4 (preferably methane and/or hydrogen) are supplied to a gas mixing device 2, wherein via the gas mixing device 2 an air-fuel mixture is produced and is fed into a supply line 5 of the combustion engine 1.

This air-fuel mixture is then compressed via a compressor 6 of an exhaust gas turbocharger 7 and cooled by means of a charge air cooler 8.

The compressor 6 can be bypassed by a bypass line 10 having a bypass valve 9, wherein, to control or regulate a boost pressure (and thus indirectly a power and/or a rotational speed of the combustion engine 1) in a known manner, an air-fuel mixture, which bypasses the compressor 6 via the bypass line 10 from the high-pressure side in the direction of the low-pressure side of the compressor 6, can be controlled or regulated by the bypass valve 9.

The cooled, compressed air-fuel mixture (represented here by way of example with combustion chambers 11 of the combustion engine 1) is then supplied.

Arranged between the charge air cooler 8 and the combustion chambers 11 in the supply line 5 is a throttle valve 12, which is formed to control or regulate the boost pressure of the combustion engine 1 by influencing the flow volume.

In these combustion chambers 11, the air-fuel mixture is compressed, combusted and expanded, wherein the thermal energy released is converted into mechanical energy.

After the combustion, the exhaust gases which are formed in the combustion and which are utilized to drive an exhaust gas turbine 14, mechanically coupled to the compressor 6, of the exhaust gas turbocharger 7 are discharged via an exhaust gas line 13.

After passing through the exhaust gas turbocharger 7, the exhaust gas can then also be supplied to an exhaust gas aftertreatment device 15, which can be formed, for example, as a three-way catalytic converter, a selective catalytic reduction (SCR) catalytic converter or also as a heat exchanger for the recovery of heat.

Figure 2:
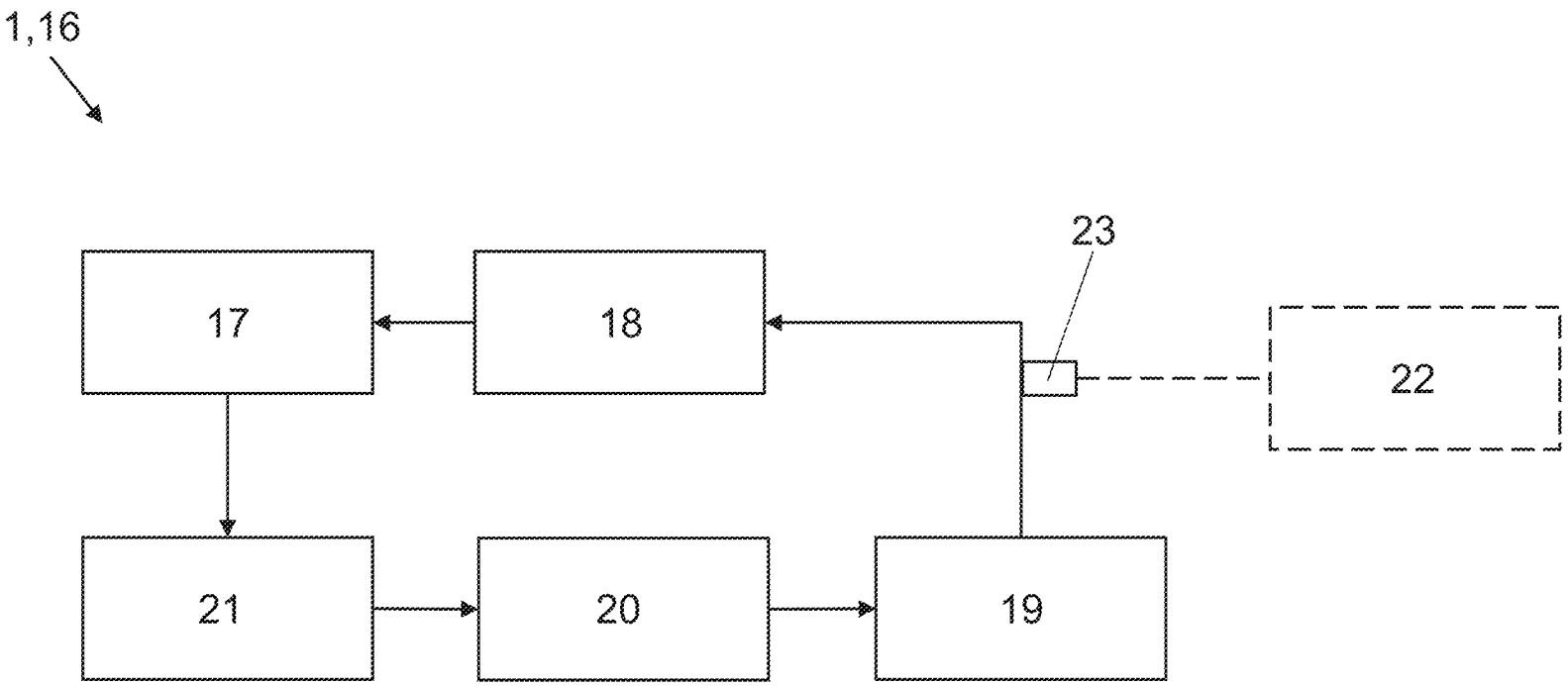
FIG. 2 illustrates an embodiment example of an oil circuit of a combustion engine.

FIG. 2 shows an embodiment example of an oil circuit 16 of a combustion engine 1, for example, such as the combustion engine 1 represented in FIG. 1.

This oil circuit 16 of the combustion engine 1 is represented schematically, wherein the arrows on the one hand indicate the flow direction of the engine oil in the oil circuit 16 and on the other hand symbolize the fluidic connection between the components, for example through an oil line.

The engine oil is conveyed from an oil pan 21 of the combustion engine 1, in which the engine oil collects, via an oil pump 20 to an oil cooler 19, which is provided to control the temperature of or cool the engine oil.

From the oil cooler 19, the engine oil passes to an oil filter 18, through which suspended matter and particles are filtered out of the engine oil, before the engine oil then enters a crankcase 17 of the combustion engine 1, in order there to serve to lubricate and/or cool the combustion engine 1 during the combustion process.

After the engine oil has been used, it collects in the oil pan 21 again, whereby the oil circuit 16 of the combustion engine 1 is closed.

The individual components of the oil circuit 16 (crankcase 17, oil filter 18, oil cooler 19, oil pump 20 and oil pan 21) are for example physically connected by a machine frame of the combustion engine 1.

Located between the oil filter 18 and the oil cooler 19 is a sensor 23, which is formed to provide at least one measured numerical value 28 representative of the oil quality of the engine oil, which measured numerical value 28 can be provided to the control or regulating device 22 (e.g., a controller) via a signal-carrying connection (represented by the dashed line).

The sensor 23 is formed here as a sensor which, via the electrical conductivity and/or permittivity of the engine oil, provides the measured numerical value 28 which is indicative of the oil quality of the engine oil. Such a sensor 23 can, for example, be implemented according to known embodiment variants of the state of the art.

The control or regulating device 22 of this embodiment example is formed to receive the measured numerical value 28 of the sensor 23 and to transform it into an absolute value 27. The absolute value 27 can, for example, reflect an oil quality of the engine oil via a percentage (0-100%).

This derived variable of the measured numerical value 28 (the absolute value 27) is compared with a condition 24 stored in the control or regulating device 22, wherein—if the measured value 28 of the sensor 23 fulfils the condition 24—the measurement is continued and, if the measured value 28 of the sensor 23 does not fulfil the condition 24, an oil sampling interval is adapted depending on at least one measured numerical value 28 and/or the absolute value 27.

The oil sampling interval is output in the form of a notification 31.

This outputting of the notification 31 by the control or regulating device 22 can be performed via a display device of the control or regulating device 22.

Figure 3:
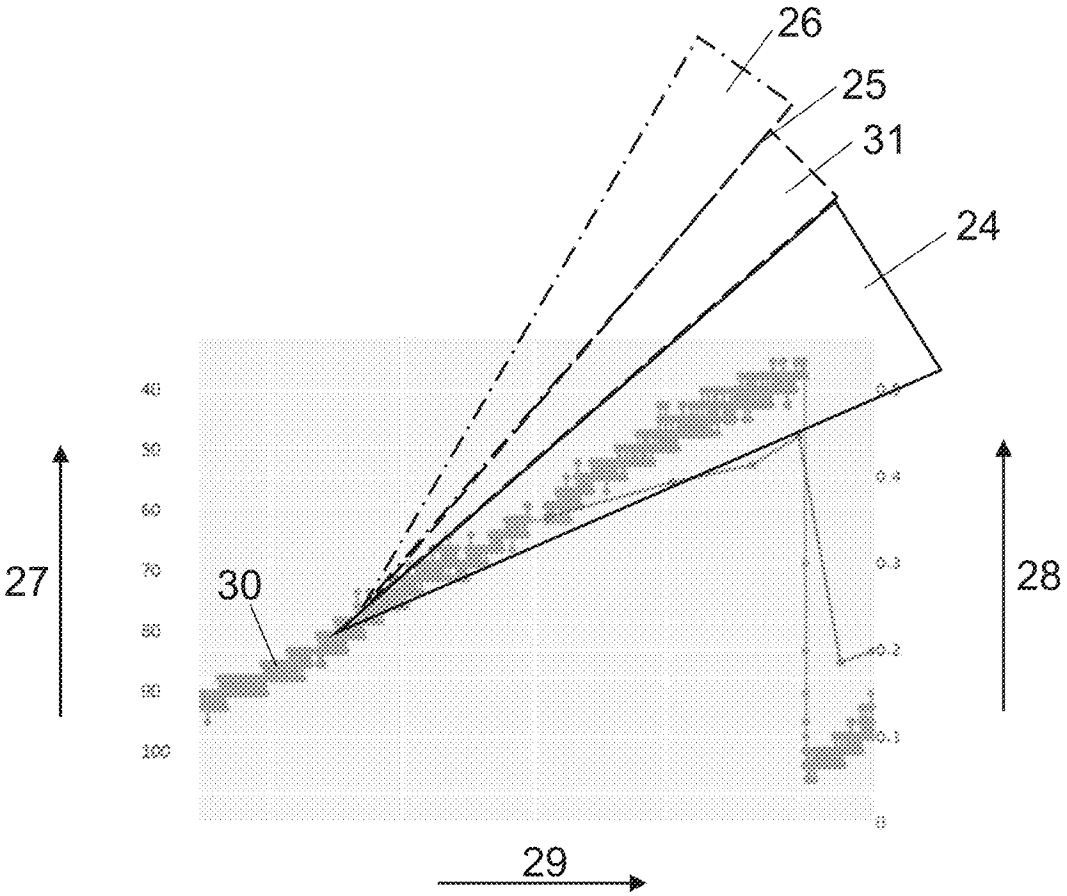
FIG. 3 illustrates an embodiment example of a method according to the invention for monitoring the condition of a lubricant of a combustion engine.

FIG. 3 shows an embodiment example according to the method according to the invention for monitoring the condition of a lubricant of the combustion engine 1 graphically.

This graph shows the relationship of measured values 28 of the sensor 23 with respect to operating hours 29 of the combustion engine 1 and what condition 24 can be stored in the control or regulating device 22.

Reference values 30 were determined via tests and simulations, which represent the acceptable ageing of an engine oil with regard to the operating hours 29 performed by the combustion engine 1.

These reference values 30 were entered in a graph, which represents the measured values 28, characteristic of the oil quality, of the sensor 23 through the variable of the absolute value 27 derived therefrom over the operating hours 29.

As can be seen, the measured numerical value 28 of the sensor 23 (which ranges between a value of 0 and 1) has been converted into a derived variable—the absolute value 27 of an oil quality of the engine oil (decreasing in the opposite direction from 100% to 0%).

Furthermore, it was defined that—if the absolute value 27 of the oil quality drops below a region of 40%—the taking of an oil sample of engine oil from the combustion engine 1 is called for immediately.

As can be seen, the reference values 30 of normal ageing with regard to the operating hours 29 of the combustion engine 1 form an approximately linear function.

The condition 24, which represents a range, was defined through this linear function.

In the case of the condition 24, possible deviations of the measured values 28 because of measuring inaccuracies as well as an acceptable variation in the oil quality were also taken into account.

This results in the condition 24, which is assigned a minimum and maximum of the permissible oil quality for each number of operating hours 29.

If, in the ongoing operation of the combustion engine 1, a measured numerical value 28 which does not fulfil the condition 24 because it exceeds a lower limit of the oil quality defined by the condition 24 is now ascertained via the sensor 23, a corresponding notification 31 in the form of an adaptation of the oil sampling interval is output by the control or regulating device 22.

This is based on the fact that such a measured numerical value 28 of the sensor 23 indicates a change in the oil quality not to be expected, as a result of which it is necessary to undertake more precise investigations by taking an oil sample of engine oil from the combustion engine 1 and forwarding it to a laboratory for detailed analysis, wherein, on the basis of the laboratory values of the engine oil, a decision can then be taken on how to proceed further with the engine oil (change or further operation of the combustion engine 1).

If, however, the oil quality 24 decreases rapidly with regard to a defined number of operating hours 29, a tolerance range 25 can also be provided, wherein, when this tolerance range 25 is exceeded, a critical notification 26 can be output by the control or regulating device 22.

Such a critical notification 26 by the control or regulating device 22 can, for example, result in the shutdown of the combustion engine 1 or the restriction (for example, of a power output) of the combustion engine 1.

The reason behind this is that such a rapid deterioration of the engine oil is not to be attributed to the normal operation of the combustion engine 1, wherein in all probability the reason behind this rapid decrease in the engine oil quality is damage to the combustion engine 1, due to which the operation of the combustion engine 1 is to be ceased immediately in order to prevent even further subsequent greater damage.

LIST OF REFERENCE NUMBERS

1 combustion engine
2 gas mixing device
3 air
4 fuel
5 supply line
6 compressor
7 exhaust gas turbocharger
8 charge air cooler
9 bypass valve
10 bypass line
11 combustion chamber
12 throttle valve
13 exhaust gas line
14 exhaust gas turbine
exhaust gas aftertreatment device
16 oil circuit
17 crankcase
18 oil filter
19 oil cooler
20 oil pump
21 oil pan
22 control or regulating device
23 sensor
24 condition
25 tolerance range
26 critical notification
27 absolute value
28 measured value
29 operating hours
30 reference values
31 notification

The invention claimed is:

1. A method for monitoring a lubricant of a combustion engine, comprising:

acquiring a plurality of measured numerical values at a measurement frequency in a range between 0.5 Hz and 3 Hz with at least one sensor at the combustion engine over a running time of the combustion engine, wherein the measured numerical values are representative of an oil quality of an engine oil of the combustion engine; and adapting an oil sampling interval for analysis of the engine oil away from the combustion engine in a laboratory depending on at least one measured numerical value of the plurality of measured numerical values and/or a variable derived therefrom, wherein adapting the oil sampling interval comprises:

shortening the oil sampling interval when the at least one measured numerical value or the variable derived therefrom indicates the oil quality is less than expected; and lengthening the oil sampling interval when the at least one measured numerical value or the variable derived therefrom indicates the oil quality is greater than expected.

2. The method of claim 1, comprising deriving an absolute value of the oil quality from the at least one measured numerical value, wherein the absolute value is used for adapting the oil sampling interval.

3. The method of claim 1, wherein acquiring the plurality of measured numerical values comprises continuously acquiring the plurality of measured numerical values during the running time of the combustion engine at the measurement frequency, wherein the method further comprises continuously determining the oil quality of the engine oil in response to the plurality of measured numerical values during the running time of the combustion engine, and continuously outputting updates to the oil sampling interval in response to any shortening and lengthening of the oil sampling interval.

4. The method of claim 1, comprising determining a rate of change of at least two successive measured numerical values of the plurality of measured numerical values, wherein adapting the oil sampling interval comprises changing the oil sampling interval in response to the rate of change.

5. The method of claim 4, wherein adapting the oil sampling interval comprises changing the oil sampling interval in response to the rate of change reaching a limit value.

6. The method of claim 1, wherein the plurality of measured numerical values comprises an iron content, an oxidation rate, a water content, an i-pH value, or a combination thereof.

7. The method of claim 1, comprising determining at least two measured numerical values of the plurality of measured numerical values and/or variables derived therefrom by the at least one sensor at prespecified points in time at time intervals prespecified relative to each other and/or in defined operating conditions of the combustion engine.

8. The method of claim 1, further comprising:

initiating an oil sample of the engine oil for the analysis of the engine oil away from the combustion engine in the laboratory in response to the oil sampling interval; and obtaining results from the analysis in the laboratory, wherein the results include laboratory values of the oil quality and a decision to change the engine oil at a first time or at a second time after further operation of the combustion engine.

9. The method of claim 1, wherein an electrochemical state variable, comprising electrical conductivity and/or permittivity, of the engine oil is measured by the at least one sensor, wherein the electrochemical state variable represents the at least one measured numerical value of the oil quality of the engine oil.

10. The method of claim 1, comprising:

comparing the plurality of measured numerical values and/or the variables derived therefrom with a condition, and adapting the oil sampling interval in response to the plurality of measured numerical values not corresponding to the condition.

11. The method of claim 10, comprising determining the condition comprising an ageing rate for the engine oil under normal conditions and/or in tests in dependence on operating hours of the combustion engine.

12. The method of claim 1, comprising outputting the oil sampling interval as a notification, and outputting a change in the oil sampling interval as a warning.

13. A combustion engine, comprising:

at least one oil circuit configured to transport the engine oil for lubricating and/or cooling the combustion engine;

the at least one sensor; and a controller configured to receive the at least one measured numerical value, wherein the controller is configured to monitor the oil quality of the engine oil and adapt the oil sampling interval depending on the at least one measured numerical value of the plurality of measured numerical values and/or the variable derived therefrom according to the method of claim 1.

14. A tangible, computer-readable medium storing instructions executable to perform the method according to claim 1.

15. A system, comprising:

a controller configured to:

acquire a plurality of measured numerical values at a measurement frequency in a range between 0.5 Hz and 3 Hz with at least one sensor at a combustion engine over a running time of the combustion engine, wherein the measured numerical values are representative of an oil quality of an engine oil of the combustion engine; and adapt an oil sampling interval for analysis of the engine oil away from the combustion engine in a laboratory depending on at least one measured numerical value of the plurality of measured numerical values and/or a variable derived therefrom, wherein the controller is configured to adapt the oil sampling interval by:

shortening the oil sampling interval when the at least one measured numerical value or the variable derived therefrom indicates the oil quality is less than expected; and lengthening the oil sampling interval when the at least one measured numerical value or the variable derived therefrom indicates the oil quality is greater than expected.

16. The system of claim 15, comprising an oil circuit configured to circulate the engine oil, wherein the oil circuit comprises the at least one sensor separate from the combustion engine.

17. The system of claim 16, wherein the oil circuit comprises an oil cooler and an oil filter, the at least one sensor is disposed at a position between the oil cooler and the oil filter, the plurality of measured numerical values are influenced by the temperature due to the position of the at least one sensor downstream of the oil cooler, the oil cooler is configured to control the temperature of the engine oil monitored by the at least one sensor, and the plurality of measured numerical values are not influenced by filtering due to the position of the at least one sensor upstream of the oil filter.

18. The system of claim 15, comprising the combustion engine having the controller.

19. A system, comprising:

a combustion engine having an oil circuit and at least one sensor along the oil circuit;

a controller configured to:

monitor the at least one sensor to obtain sensor feedback at a measurement frequency in a range between 0.5 Hz and 3 Hz, wherein the sensor feedback or a variable derived therefrom indicates an oil quality of an engine oil of the combustion engine; and adapt an oil sampling interval for analysis of the engine oil away from the combustion engine in a laboratory based on the sensor feedback or the variable derived therefrom, wherein the controller is configured to adapt the oil sampling interval by:

shortening the oil sampling interval when the sensor feedback or the variable derived therefrom indicates the oil quality is less than expected; and lengthening the oil sampling interval when the sensor feedback or the variable derived therefrom indicates the oil quality is greater than expected.

20. The system of claim 19, wherein the controller is configured to adapt the oil sampling interval at least by changing the oil sampling interval based on a comparison between a condition and the sensor feedback or the variable derived therefrom, wherein the condition is representative of an expected oil quality or an expected ageing rate for the engine oil under normal conditions and/or in tests in dependence on operating hours of the combustion engine.

21. The system of claim 19, wherein the controller is configured to adapt the oil sampling interval based on a rate of change of the sensor feedback or the variable derived therefrom.

22. The system of claim 21, wherein the sensor feedback or the variable derived therefrom comprises an iron content, an oxidation rate, a water content, an i-pH value, or a combination thereof.

23. The system of claim 19, wherein the controller is configured to;

perform a plausibility check to classify the sensor feedback or variables derived therefrom as plausible or non-plausible based on plausibility limits;

adapt the oil sampling interval in response to the plausibility check classifying the sensor feedback or variables derived therefrom as plausible; and not adapt the oil sampling interval in response to the plausibility check classifying the sensor feedback or variables derived therefrom as non-plausible.

* * * * *